US007867024B2

(12) United States Patent
Fraysse et al.

(10) Patent No.: US 7,867,024 B2
(45) Date of Patent: Jan. 11, 2011

(54) DEVICE FOR FIXING AT LEAST ONE COUPLING TO A CARRIER PART

(75) Inventors: Didier Fraysse, Savigny sur Orge (FR); Steve Mouchet, Grenoble (FR); Jean-Baptiste Pau, Annemasse (FR)

(73) Assignee: A. Raymond et Cie, Grenoble (FR)

( * ) Notice: Subject to any disclaimer, the term of this patent is extended or adjusted under 35 U.S.C. 154(b) by 93 days.

(21) Appl. No.: 12/444,977

(22) PCT Filed: Nov. 8, 2007

(86) PCT No.: PCT/EP2007/009672

§ 371 (c)(1),
(2), (4) Date: Apr. 9, 2009

(87) PCT Pub. No.: WO2008/064764

PCT Pub. Date: Jun. 5, 2008

(65) Prior Publication Data

US 2010/0210137 A1 Aug. 19, 2010

(30) Foreign Application Priority Data

Dec. 1, 2006 (DE) ..... 10 2006 056 724

(51) Int. Cl.
*H01R 13/60* (2006.01)

(52) U.S. Cl. ..... 439/575

(58) Field of Classification Search ..... 439/575, 439/571, 542, 570, 549, 546, 553, 527
See application file for complete search history.

(56) References Cited

U.S. PATENT DOCUMENTS

| | | | | |
|---|---|---|---|---|
| 3,440,596 | A * | 4/1969 | Frompovicz | 439/695 |
| 3,579,170 | A * | 5/1971 | Baumanis et al. | 439/353 |
| 4,227,238 | A * | 10/1980 | Saito | 361/801 |
| 5,049,092 | A * | 9/1991 | Takano et al. | 439/540.1 |
| 5,636,937 | A | 6/1997 | Zemlicka | |

FOREIGN PATENT DOCUMENTS

| | | |
|---|---|---|
| EP | 1345290 A1 | 9/2003 |
| FR | 2117082 A5 | 7/1972 |

* cited by examiner

*Primary Examiner*—T C Patel
*Assistant Examiner*—Phuongchi T Nguyen
(74) *Attorney, Agent, or Firm*—Baker & Daniels LLP

(57) ABSTRACT

For fastening a coupling (1) formed from one plug-in part (2) and one sliding part (4) to a carrier part, a retaining arrangement (9) constructed of at least one side part (10, 11) from each opposite side is proposed. Each of the side parts (10, 11) has a spring arm (20) to which a bracket (23) is attached that grips the shaped collar (6) of the plug-in part (2) from behind in such a way that the collar (6), after pushing in the plug-in part (2) from the entry side (14), is in contact with a termination rib (24). Thus the plug-in part (2) is left fixed on the carrier part without both parts (2, 4) of the coupling (1) having to be plugged together when the sliding part (4) is slid.

8 Claims, 2 Drawing Sheets

DEVICE FOR FIXING AT LEAST ONE COUPLING TO A CARRIER PART

CROSS-REFERENCE TO RELATED APPLICATION

This application is a U.S. National Phase patent application based on International Application Serial No. PCT/EP2007/009672 filed Nov. 8, 2007, the disclosure of which is hereby explicitly incorporated by reference herein.

BACKGROUND OF THE INVENTION

1. Field of the Invention

The invention is directed to a device for fixing at least one coupling to a carrier part.

2. Description of the Related Art

Known from practice are devices for fixing couplings to a carrier part, which devices comprise a carrier that is to be fastened to the carrier part and is configured with a number of resilient snap hooks that protrude from the carrier opposite each other in pairs and that reach around the coupling to fix it in place. Although with these prior devices the couplings are fixed to the carrier well enough to prevent inadvertent detachment, the two parts of a given coupling first have to be joined together. This, however, is impractical in some applications and downright impossible in others.

SUMMARY OF THE INVENTION

The present invention provides a device for fixing at least one coupling to a carrier part according to which the plug-in part, which is configured with a collar, can be reliably connected to the carrier, and the sliding part can therefore be connected to the plug-in part after the latter has been fastened in place.

By virtue of the design of the device according to the invention, the plug-in part can be fixed in place ahead of time by sliding it in between the side parts and snap-locking the collar with the latching element, so that the sliding part can now be connected to the plug-in part without any risk of the plug-in part detaching from the device.

In one form thereof, the present invention provides a device for fixing at least one coupling, including a plug-in part configured with a radially outwardly protruding collar and a sliding part that is to be connected to the plug-in part by being slid thereonto, to a carrier part including a carrier to be fastened to the carrier part, two elongated side parts mounted on the carrier and oriented spacedly parallel to each other, the side parts each being provided with a respective side wall disposed on the carrier and with a respective cover wall disposed on the opposite side of the side wall from the carrier and extending in the direction of the respective other side part, the mutually facing end sides of the cover walls being spaced apart from each other by a distance that is equal to the outer diameter of a line connected to the plug-in part, and each being configured with a spring arm bearing a latching element that points in the direction of the carrier and cooperates with the collar to retain the plug-in part between the side parts in a manner that secures it against sliding out.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
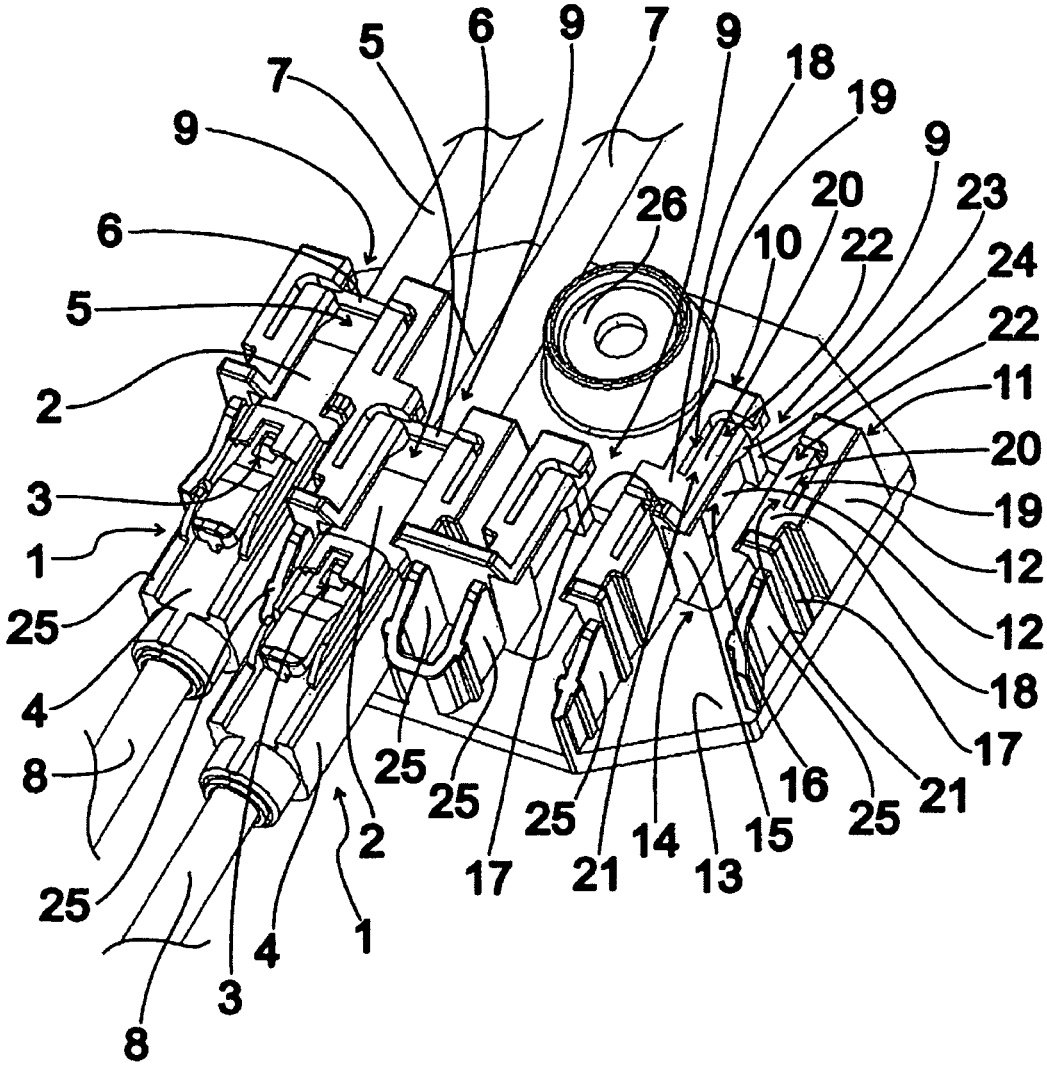
FIG. 1 is a perspective view of an exemplary embodiment of a device according to the invention for fixing four couplings to a carrier part.

Corresponding reference characters indicate corresponding parts throughout the several views. Although the exemplifications set out herein illustrate embodiments of the invention, the embodiments disclosed below are not intended to be exhaustive or to be construed as limiting the scope of the invention to the precise forms disclosed.

DETAILED DESCRIPTION

FIG. 1 is a perspective view of an exemplary embodiment of a device according to the invention for fixing four FAKRA type couplings 1, only two couplings 1 being shown in FIG. 1. Each coupling 1 is provided with a plug-in part 2 and with a sliding part 4 that can be slid onto the plug-in part 2 and latched to it by means of a latch mechanism 3. Each plug-in part 2 has, at its opposite end from the latch mechanism 3, a circumferential depression 5 and an also circumferential collar 6 of square cross section, which bounds the depression 5 endwise. The plug-in parts 2 and the sliding parts 4 of the coupling 1 are each connected to end portions of lines 7, 8, such as antenna lines, for example, between which a connection is to be made.

It can be seen from FIG. 1 that to fix a total of four couplings 1, the exemplary embodiment is provided with a total of four retaining arrangements 9, each of identical construction, although in FIG. 1, for ease of visualization, only one retaining arrangement 9 is shown with all the reference numerals assigned in the following description.

Each retaining arrangement 9 comprises two elongated side parts 10, 11 that are oriented spacedly parallel to each other, each of which has a side wall 12 that is connected by one of its long sides, and at a slight inclination toward the respective other side wall, to a carrier 13 which is configured in this exemplary embodiment as a flat plate. Each side wall 12 has a flat guide portion 15, which is disposed at an insertion side 14 (located in front in the representation of FIG. 1) of the retaining arrangement 9 and which protrudes inward relative to a wall recess 16 disposed on that side of guide portion 15 which faces away from the insertion side 14.

On the edge side facing toward insertion side 14, each side wall 12 is configured with a protruding stiffening flange 17, which is disposed radially outwardly on the side wall 12 and extends from the carrier 13 to the longitudinal side of side wall 12 remote from the carrier 13, and extends by a hook-shaped end portion toward the opposite side part 10, 11 of the particular retaining arrangement 9.

It can further be appreciated from FIG. 1 that each side part 10, 11 comprises, formed onto the respective side wall 12 on its opposite edge side from the carrier 13, a cover wall 18 that extends parallel to the carrier 13 from that side wall 12 toward the opposite side part 10, 11 of the retaining arrangement 9, the mutually facing end sides of the cover walls 18 being spaced apart from each other by a distance that is at least equal to the diameter of the line 7 connected to the plug-in part 2.

The distance between the guide portions 15 of the side walls 12 of the side parts 10, 11 of a retaining arrangement 9 and the distance between the carrier 13 and the cover walls 18 are substantially the same, to within very slight play, as the ordinarily square dimensions of the plug-in part 2, thus allowing the plug-in part 2, after the line 7 connected to it has been inserted in the retaining arrangement 9, to be slid in between the side parts 10, 11 of said retaining arrangement 9.

Each cover wall 18 in this exemplary embodiment is formed, by means of an L-shaped clearance 19, into a spring arm 20, whose flexion zone 21 is located on the side of the retaining arrangement 9 proximate the insertion side 14, at the end of guide portion 15 remote from the insertion side 14, and at whose free end 22 remote from insertion side 14 is configured, as a latching element, a latching projection 23 that extends in the direction of the carrier 13.

In an exemplary embodiment not shown, instead of the L-shaped clearance 19 a U-shaped clearance 19 is formed, such that the spring arms 20 are fully integrated into the cover plates 18 and are thus protected especially well against damage.

Finally, each side part 10, 11 of a retaining arrangement 9 is provided, on the side facing away from insertion side 14, with a terminating rib 24 that is formed onto a respective one of the side walls 12 and extends from the carrier 13 to the respective cover wall 18.

In the exemplary embodiment according to FIG. 1, guide walls 25 are disposed in front of the retaining arrangements 9 on the insertion side 14 in prolongation of the side walls 12, to facilitate the insertion of a plug-in part 2 into a retaining arrangement 9 and the sliding of a sliding part 4 onto a plug-in part 2 fixed in a retaining arrangement 9.

Configured on the carrier 13 is a fastening arrangement 26 that serves to fasten said carrier 13 to a carrier part not shown in FIG. 1.

Figure 2:
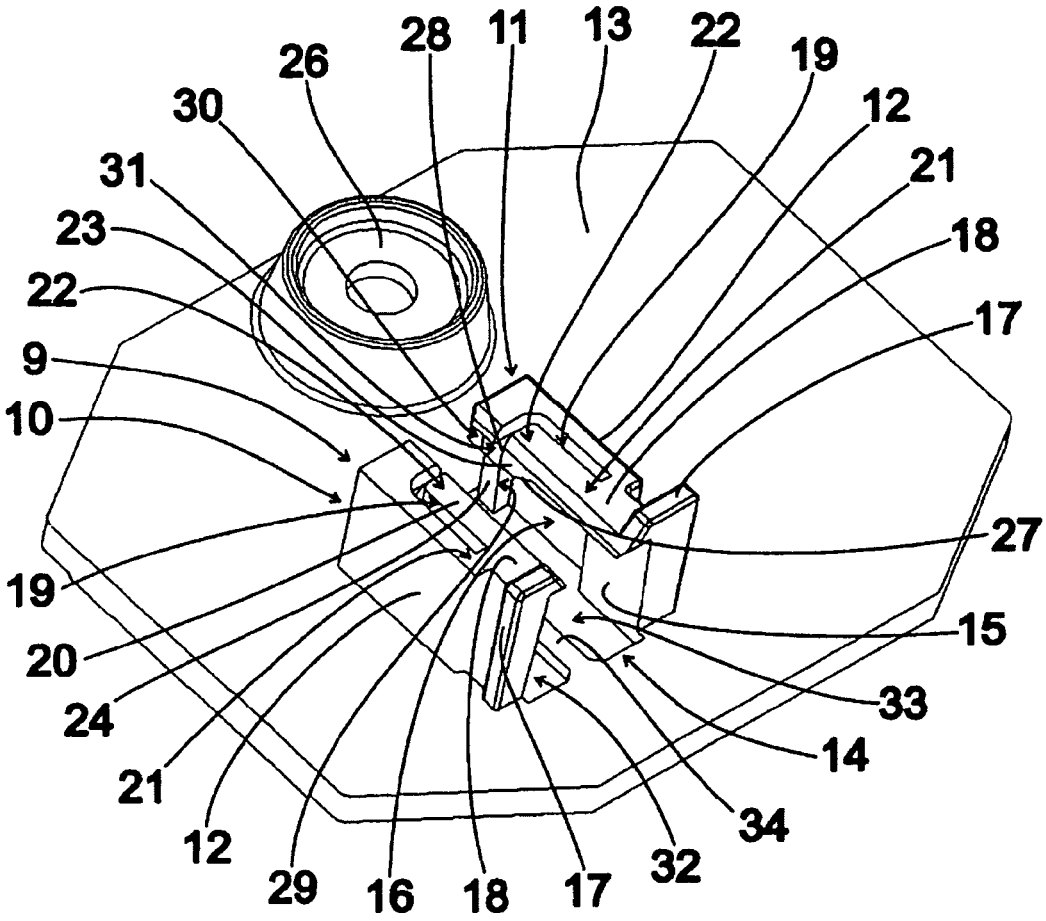
FIG. 2 is a perspective view of another exemplary embodiment of a device according to the invention, for fixing one coupling to a carrier part.

FIG. 2 is a perspective view of another exemplary embodiment of a device according to the invention, comprising a retaining arrangement 9 disposed on a carrier 13 and, also configured on the carrier 13, a fastening arrangement 26 having the same construction as the exemplary embodiment described with reference to FIG. 1. It can be seen from FIG. 2 that the latching projection 23 comprises a ramp 27 that faces toward the insertion side 14 and slopes upward to the carrier 13 in the direction away from the insertion side 14, and has on its side facing away from the insertion side 14 a flat abutment surface 28 that is oriented perpendicular to the carrier 13.

It can further be appreciated from FIG. 2 that each terminating rib 24 has, formed on the carrier 13, a rectangular-prism-shaped columnar portion 29, the flat side of each of which that faces the other being flush with the guide portion 15 of the respective side wall 12 on which the respective terminating rib 24 is formed. Each terminating rib 24 further comprises, on its side facing toward the respective cover wall 18, an abutment portion 30, which is disposed between the columnar portion 29 and the cover wall 18 and extends beyond the mutually facing flat sides of the columnar portions 29 in the direction of the respective opposite side part 10, 11 of the retaining arrangement 9, such that the abutment portions 30 narrow the cross section of the retaining arrangement 9 relative to the columnar portions 29. This results in the formation, between the abutment surfaces 28 and the abutment portions 30 of each side part 10, 11 of a retaining arrangement 9, of collar receiving spaces 31 which are usefully so dimensioned that the collars 6 of the plug-in parts 2 are disposed between abutment surfaces 28 and abutment portions 30 with substantially no play, or at most very little.

Formed in the carrier 13 between and adjacent to side parts 10, 11 are carrier recesses 32, 33, which have a stabilizing intermediate web 34 between them and which are provided to receive prominences that are present on the plug-in part 2.

Examining FIGS. 1 and 2 together, a coupling 1 can thus be fixed in a retaining arrangement 9 as follows. After the line 7 connected to plug-in part 2 has been arranged between side parts 10, 11, plug-in part 2 is slid into retaining arrangement 9 from insertion side 14 in the direction of terminating ribs 24, during which process, as the distance to the terminating ribs 24 narrows, the ramps 27 slide past the collar 6, deflecting the spring arms 20 outward. After the collar 6 has entered the collar receiving spaces 31, the spring arms 20, due to the tension built up in the flexion zones 21 as the latching projections 23 enter, snap into the depression 5 formed in the back of the collar 6, with the result that collar 6 is blocked against being slid farther in by its abutment against abutment portions 30, and is secured against inadvertently sliding out in the opposite direction, to the insertion side 14, by the engagement of the abutment surfaces 28 behind the collar 6.

In this fixed position, sliding part 4 can now be slid onto plug-in part 2, in the arrangement depicted in FIG. 1, if the two parts of the coupling 1, i.e., plug-in part 2 and sliding part 4, were not already connected to each other before line 7 was placed in retaining arrangement 9.

The plug-in part 2 or the coupling 1 as a whole can be removed from the retaining arrangement 9 by lifting the spring arms 20 with a tool, for example the blade of a screwdriver, far enough away from the carrier 13 so that the engagement of the abutment surfaces 28 behind the collar 6 is released and the plug-in part 2 can be slid toward the insertion side 14 until it comes out of the side parts 10, 11.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A device for fixing at least one coupling, comprising:

a plug-in part including a radially outwardly protruding collar and a sliding part slidingly connected to said plug-in part; and a carrier part including a carrier, two elongated side parts mounted on said carrier, said side parts spaced from each another and oriented parallel to each other, said side parts each including a respective side wall disposed on said carrier and a respective cover wall disposed on an opposite side of said side wall from said carrier and extending in a direction of the respective other said side part, with mutually facing end sides of said cover walls spaced apart from each other by a distance equal to an outer diameter of a line connected to said plug-in part, and each being configured with a spring arm having a latching element that points in a direction of said carrier and cooperates with said collar to retain said plug-in part between said side parts.

2. The device of claim 1, wherein said spring arms are respectively defined by one of an L-shaped clearance and a U-shaped clearance formed in said cover walls.

3. The device of claim 1, wherein at least one of said spring arms includes a terminating rib disposed between a flexion zone and said latching element, said terminating rib disposed spacedly adjacent to said latching element and projecting inwardly in a direction of the respective other said side part.

4. The device of claim 3, wherein each said latching element is formed by a latching projection that protrudes in a direction of said carrier.

5. The device of claim 4, wherein each said latching projection includes a ramp that slopes upwardly in a direction of said carrier and in a direction away from said insertion side and, on an opposite side from said ramp, an abutment surface is oriented perpendicularly to said carrier.

6. The device of claim 3, wherein each said terminating rib is formed endwise of its respective side part.

7. The device of claim 6, wherein each said side part includes, on a side opposite from its respective said terminating rib, a guide portion projecting inwardly toward a respective other side part a distance equal to said terminating rib, said guide portion extending from an end of its respective said side part which faces said insertion side to its respective said flexion zone.

8. The device of claim 7, further comprising an outwardly projecting stiffening flange formed proximate said guide portion of each said side part.

* * * * *